United States Patent [19]

Moench et al.

[11] 4,175,886

[45] Nov. 27, 1979

[54] ASPHALT CUTTING APPARATUS

[76] Inventors: Frank F. Moench; Lawrence R. Moench, both of P.O. Box 6484, Albuquerque, N. Mex. 87107

[21] Appl. No.: 906,273

[22] Filed: May 15, 1978

[51] Int. Cl.[2] ..... E01C 23/12

[52] U.S. Cl. ..... 404/90; 172/452; 172/582; 172/464; 172/667; 299/40

[58] Field of Search ..... 404/90; 299/40; 172/673, 667, 464, 452, 582, 476, 446, 646, 649, 656

[56] References Cited

U.S. PATENT DOCUMENTS

| | | | |
|---|---|---|---|
| 705,889 | 7/1902 | Wrobel | 404/90 X |
| 845,902 | 3/1907 | Sharp | 172/582 |
| 1,276,686 | 8/1918 | Petermann | 404/90 X |
| 2,036,598 | 4/1936 | Miller | 404/90 X |
| 2,138,904 | 12/1938 | Carswell | 404/90 |
| 2,838,987 | 6/1958 | Burton | 172/582 |
| 3,275,087 | 9/1966 | Petitt | 172/582 X |
| 3,693,725 | 9/1972 | Tonsfeldt | 172/656 X |
| 3,756,203 | 9/1973 | Dedoes | 172/464 |
| 4,060,254 | 11/1977 | Ernst | 172/667 X |

*Primary Examiner*—Nile C. Byers, Jr.

*Attorney, Agent, or Firm*—Ancel W. Lewis, Jr.

[57] ABSTRACT

Asphalt cutting apparatus for breaking up and windrowing old asphaltic pavement on a roadway or the like including the pavement adjacent to a curb or gutter. A plurality of laterally spaced, sharpened cutter discs are freely rotatably mounted on a support carriage. The support carriage is attached to a frame pivotally coupled at a forward pivot to a prime mover such as a truck or similar vehicle for movement along the asphalt surface. As the cutter discs are moved along the asphalt surface a hydraulic clamp cylinder provides a vertical movement about the forward pivot to vary the depth of cut and also maintains a downward pressure on the cutter discs and forces the discs to roll through and cut up the asphalt. The construction and mounting of the support carriage is such that the discs are adjustably movable laterally axially along a horizontal axis for selective positioning adjacent to a curb or gutter and are further adjustably movable about a pivot to slope laterally outwardly and downwardly so that the discs are positioned at different cutting depths relative to one another for cutting an asphalt surface that is sloped for drainage purposes.

6 Claims, 6 Drawing Figures

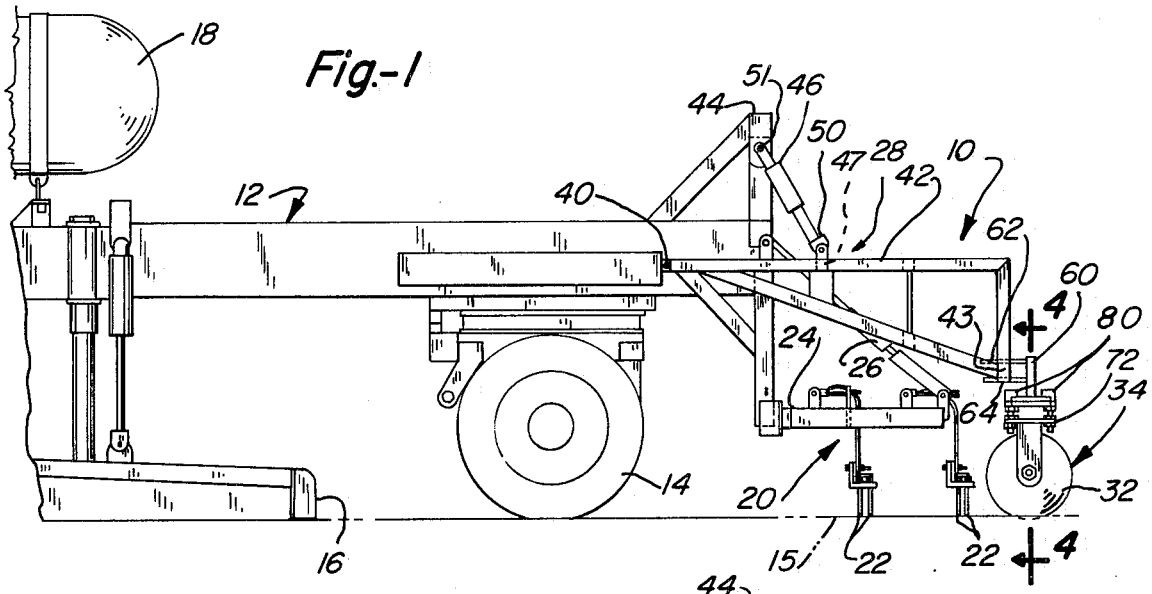
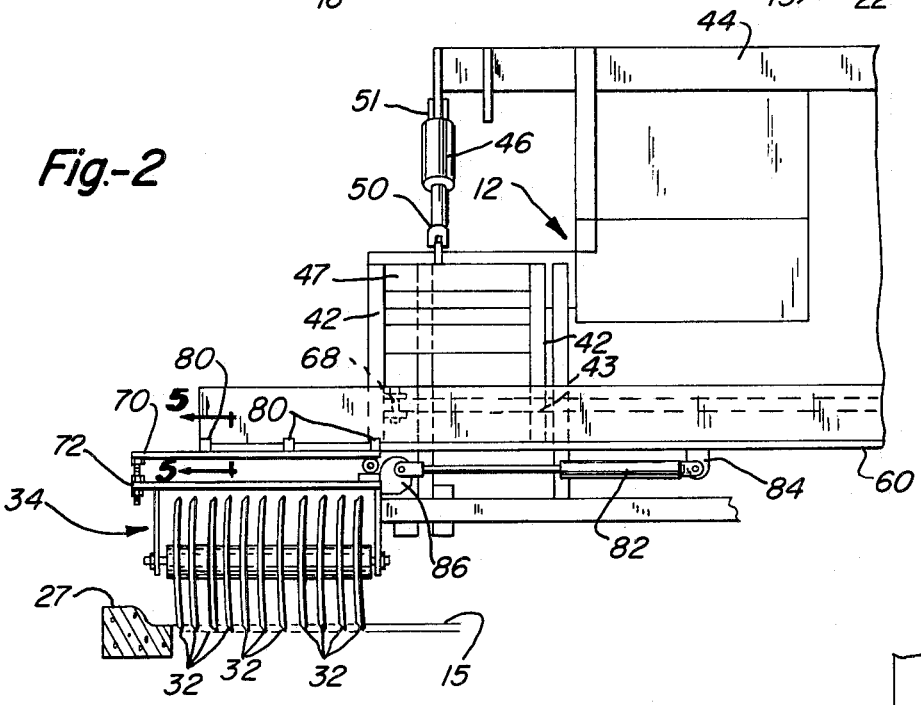
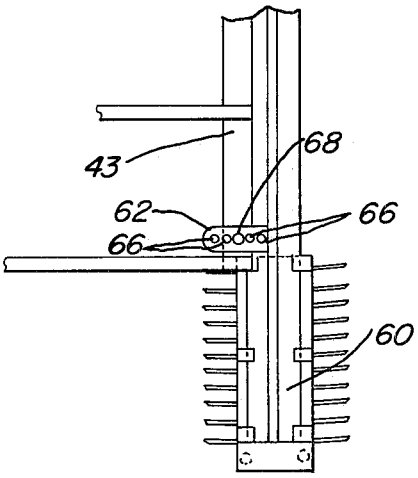
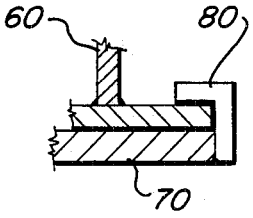
Fig_5

ASPHALT CUTTING APPARATUS

FIELD OF THE INVENTION

This invention generally relates to asphalt paving equipment and more particularly to asphalt cutting apparatus for breaking up and windrowing layers of asphalt pavement on existing roadways.

BACKGROUND OF THE INVENTION

Asphalt surfaces are widely used in the construction of highways and parking areas where large areas need to be covered with a relatively hard, flat, weather-resistant surface suitable for vehicular travel. With prolonged usage such surfaces generally develop soft spots and various irregularities that necessitate reconditioning of the surface. In the past it has been common practice to recondition a worn asphaltic surface by hot application of a new mat of asphaltic material over the existing surface to form a new flat surface. A more recent practice is to recondition old asphaltic surfaces by breaking up the existing asphalt aggregate material, picking up the material for reconditioning and heating, and then reapplying the heated reconditioned material as a new mat.

For breaking up an existing pavement the pavement is generally heated and then scarified to a certain depth by a scarifying tool having a plurality of vertical spikes that are forced into and pulled through the existing surface. A problem with such scarifying tools is that the pavement is broken up into large irregular chunks that are difficult to handle. In addition it is sometimes difficult to control the cutting depth and the direction of movement of the scarifying tool across the pavement and to angulate the tool to match the contour of a pavement that slopes downward from its centerline for drainage. Also it is difficult for a scarifying tool to dislodge all of the pavement adjacent to a concrete curb or gutter, especially where numerous asphalt overlays have elevated the asphaltic surface above the level of the gutter. In the past it has been common practice to remove the material along a curb or gutter manually with hand tools.

Accordingly, it is an object of the present invention to provide simple, durable and efficient apparatus for dislodging and breaking up old asphaltic surfaces and for windrowing the broken material for easy removal.

Another object of the present invention is to provide apparatus effective for cutting cutting away asphaltic material from a curb or gutter.

Yet another object of the present invention is to provide apparatus for use in combination with a scarifying tool for further dislodging and windrowing scarified pavement for easy removal of the material.

A further object of the present invention is to provide apparatus for cutting up existing asphaltic pavement that is highly versatile so as to be adjustable to control the depth, lateral slope, and horizontal location of the cutters and the angle of the cutters relative to the direction of apparatus movement.

SUMMARY OF THE INVENTION

Asphalt cutting apparatus for breaking up and windrowing asphaltic material on an asphalt surface including the material adjacent to a curb or gutter. The apparatus generally comprises a plurality of laterally spaced, sharpened cutter discs freely rotatably mounted on a support carriage for movement across the asphalt surface. The support carriage is adjustably movably attached to a framework that is pivotally coupled at a front end portion to the rear end of a prime mover such as a truck or similar wheeled vehicle for pulling the apparatus along the asphalt surface. In operation, as the discs are pulled along the asphalt surface a hydraulic clamp cylinder pivots the frame for vertical movement about the front pivot coupling to adjust the depth of cut and also maintains a downward force on the cutter discs forcing the cutter discs to roll through and break up the asphaltic material. In addition to breaking up the asphaltic material, the free rolling action of the cutter discs tends to windrow the broken-up material into piles for easy removal. The support carriage is adjustably movable for moving the cutter discs laterally axially along a horizontal axis for horizontally locating the discs relative to a curb or gutter, adjustably movable for orienting the cutter discs at different angles to the direction of motion of the frame for increasing or decreasing the windrow effect of the discs, and is further adjustably movable about a pivot to slope laterally outwardly and downwardly for changing the lateral slope and thereby the cutting depth of the discs relative to one another for cutting an asphalt surface that is sloped for drainage purposes.

Other objects, advantages and capabilities of the present invention will become more apparent as the description proceeds, taken in conjunction with the accompanying drawings in which like parts have similar reference numerals and in which:

FIG. 1 is a side elevation view of the asphalt cutting apparatus of the present invention mounted at the rear end of a vehicle adjacent to a scarifying tool on the vehicle;

FIG. 2 is a rear elevation view of one end of FIG. 1;

FIG. 3 is a plan view of a portion of the framework of the apparatus;

FIG. 5 is an enlarged cross-sectional view along section line 5—5 of FIG. 2.

DESCRIPTION OF THE PREFERRED EMBODIMENTS

Figure 4:
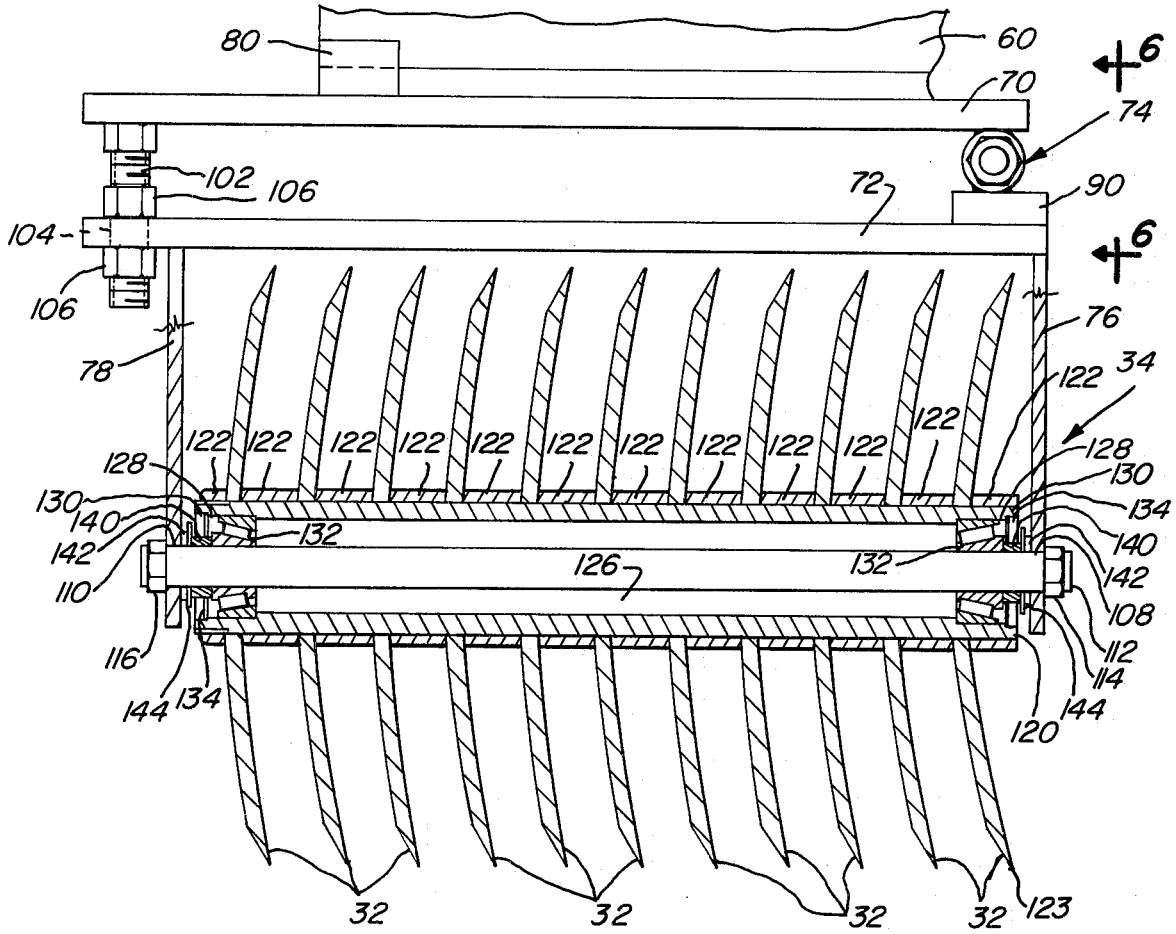
FIG. 4 is an enlarged cross-sectional view along section line 4—4 of FIG. 1.

Referring now to FIG. 1, the asphalt cutting apparatus of the invention, generally designated as 10, is shown mounted to a trailer frame generally designated 12. The trailer frame 12 is supported on sets of rear wheels 14 and front wheels (not shown) for pulling by a prime mover such as a tractor truck (not shown) or the like over the asphaltic surface to be treated, represented by broken line 15.

The trailer 12 includes a gas-fired combustion device 16 for heating the asphaltic pavement to be treated and a gas storage tank 18 for storing a fuel supply for the combustion device 16. The combustion device 16 may be similar to the combustion furnaces disclosed in U.S. Pat. Nos. 3,279,458, 3,233,605, and 3,989,401 and typically directs a high volume of heated gas onto the pavement for softening the asphaltic material as the prime mover moves across the pavement.

The trailer frame 12 also has a scarifying tool generally designated as 20 mounted at the end of the trailer frame 12 ahead of the asphalt cutting apparatus 10. The scarifying tool 20 may be similar to the tool disclosed in U.S. Pat. No. 3,989,401 and generally comprises sets of spring-loaded vertical spikes 22 that are pushed into and pulled through the heated pavement for breaking up the pavement. The vertical spikes 22 are mounted to a support structure 24 that includes a hydraulic cylinder 26 for pushing the spikes 22 into the heated pavement and for holding the spikes beneath the pavement surface 15 as the spikes are pulled through the pavement. In operation, as the prime mover pulls the scarifying tool 20 across the heated pavement, the pavement is broken up into irregular-sized chunks of asphalt aggregate material.

The asphalt cutting apparatus of the invention 10 is mounted to the trailer 12 or like vehicle behind the scarifying tool to further break up and windrow the irregular-sized chunks of material produced by the scarifying tool and to trim the asphalt material adjacent to the pavement's curb and gutter 27 (FIG. 3). Generally stated, the asphalt cutting apparatus 10 comprises a main frame 28 for supporting and mounting the apparatus on the trailer frame 12, and a plurality of disc-like members or cutter discs 32 freely rotatably mounted at laterally spaced intervals to a support carriage 34 for cutting up and windrowing the asphalt material. As will hereinafter be explained, the support carriage 34 can be moved laterally axially along a horizontal axis for positioning the cutter discs 32 adjacent to the gutter for trimming material from the gutter 27, positioned at an angle to the direction of motion of the trailer and frame 28 for orienting the cutter discs 32 at an angle to the direction of motion of the frame for windrowing the broken material, pivoted for vertical movement about a forward hitch point for the frame, and also pivoted about a horizontal axis for changing the lateral slope of the cutter discs 32 and thereby the cutting depth of the cutter discs 32 relative to one another for making a cut that slopes toward the gutter 27 for drainage purposes.

As shown in FIG. 1, the main frame 28 of the apparatus is an all-welded unitary structure fabricated mainly from tubular steel members. A stationary horizontal support portion of the trailer frame 12 is used for mounting the frame 28 to the trailer frame 12. The main frame 28 includes a pair of laterally spaced, triangular, tubular steel support members 42 (FIG. 2), each pivotally attached at a front pivot 40 extending axially of the direction of vehicle movement to the horizontal support portion of the trailer frame 12, and members 42 extend generally parallel to the longitudinal axis of the trailer frame 12. In addition to triangular support members 42 and cross support member 43, a laterally extending horizontal support member 44 is attached to the trailer frame 12 for mounting a two-way hydraulic clamp cylinder 46.

The clamp cylinder 46 is attached to support member 44 and to a cross brace 47 located between the triangular support members 42 utilizing clevis connectors 50 and 51. The clamp cylinder 46 is extended or retracted for pivoting the framework 28 with respect to the trailer frame 12 for raising and lowering the cutter discs support carriage 34 and cutter discs 32 to adjust the depth of the cutter discs. In addition, during operation of the asphalt cutting apparatus 10, the clamp cylinder 46 is extended for maintaining a downward force on the cutter discs, forcing the cutter discs 32 to roll through and cut up the asphalt material.

A generally T-shaped slide support 60 is adjustably movably mounted to cross support member 43 of the frame for slidably mounting the support carriage 34 to the main frame 28. The slide support 60 is fabricated from two flat metal plates welded together at right angles to one another to form the T-shape. The slide support 60 has two pairs of parallel, spaced, pivot plates 62 and 64 (one pair shown) welded at opposite ends of the slide support 60 for adjustably attaching the slide support 60 to cross support member 43 of the main frame.

As shown in FIG. 3, each of the pivot plates 62 and 64 has a row of spaced through holes 66 that aline with corresponding holes on the associated opposite pivot plate. The location of these holes 66 allows the slide support 60 to be adjustably movably mounted at different mounting angles to the cross support member 43 and thus to the direction of motion of the main frame.

For attaching the slide support 60 to the cross support member 43 of the main frame 28, the pairs of pivot plates 62 and 64 on both ends of the slide support 60 are placed on either side of the cross support member 43 with the slide member 60 oriented at the desired mounting angle to the cross support member 43. A pin connector 68 is then placed through the alined holes on the pivot plates 62 and 64 through a mounting hole on the cross support member 43 at both ends of the cross support member 43 to secure the slide support 60 to the cross support member 43.

In FIG. 3 the slide support 60 is shown mounted approximately parallel to the cross support member 43 and perpendicular to the longitudinal axis of the main and trailer frames. Different mounting holes 66 may be utilized, however, for changing the mounting angle of the slide support 60 with respect to the cross support member 43. As will hereinafter be explained, this arrangement permits the cutter discs 32 to be oriented at an angle to the direction of motion of the main frame 28 for windrowing the broken-up asphalt material. Although the mounting angle of the slide support 60 with respect to the cross support 43 may be varied for changing the orientation of the cutter discs, the slide support 60 is always positioned as shown in FIG. 2 with its longitudinal axis in a generally horizontal plane for providing a horizontal slide surface for the cutter disc assembly 34.

Referring now to FIG. 4, the cutter disc support carriage 34 is shown in an enlarged elevation view. The support carriage 34 generally comprises a slide plate 70 adjustably slidably mounted to the slide support 60 for axially moving the cutter discs 32, a pivot plate 72 attached by a pivot connection 74 to the slide plate 70 for pivoting the cutter discs for changing the lateral slope and thereby cutting depth of the cutter discs for cutting a sloped pavement, and a pair of vertical mounting plates 76, 78 attached at right angles to the pivot plate 74 for rotatably mounting the cutter discs 32.

Slide plate 70 of the support carriage 34 is adjustably movably mounted to the slide support 60 utilizing three sets of retaining clips 80. A retaining clip 80 is shown in an enlarged view of FIG. 5. The retaining clips 80 are L-shaped metal clips that are preferably welded to the slide plate 70 in pairs opposite to one another. The L-shaped configuration of the retaining clips 80 retains the slide plate 70 on the slide member 60 suspended from the slide member 60 but permits the slide plate 70 to be moved laterally axially in a horizontal direction along the slide support 60. A two-way hydraulic cylinder 82 (FIG. 2) is attached at one end by a clevis connector 84 to the bottom of the slide support 60 and at its other end by another clevis connector 86 to the support carriage 34. The hydraulic cylinder 82 can be extended and retracted for adjustably moving or sliding the slide plate 70 across the slide support 60 for changing the horizontal location of the cutter discs 32.

Figure 6:
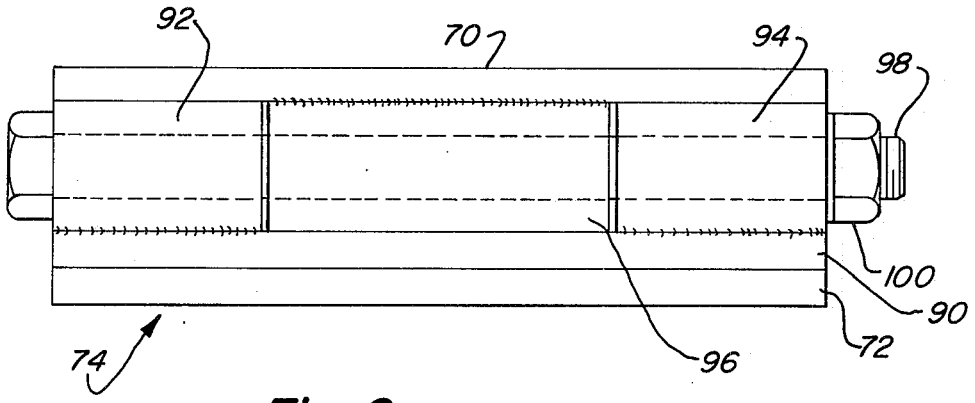
FIG. 6 is an end view along section line 6—6 of FIG. 4.

Pivot plate 72 of the support carriage 34 is a rectangular metal plate identical in size to slide plate 70. A rectangular boss plate 90 is attached at one end of the pivot plate 72, preferably by welding, for mounting the pivot connection 74 to the pivot plate 72. The pivot connection 74 is shown in a detail view in FIG. 6 and comprises a pair of cylindrical bushings 92, 94 welded to the boss plate 90, a single cylindrical bushing 96 welded to the slide plate 70, and a support stud 98 placed through the bushings 92, 94, 96 and secured to the bushings with a nut 100 threaded to the end of the stud 98. This arrangement permits the pivot plate 72 to be rotated or pivoted relative to the slide plate 70 to position the cutter discs 32 at different lateral slopes and thereby cutting depths relative to one another for cutting a sloped surface. Two pivot adjusting bolts 102 (FIG. 4) are welded to the slide plate 70, placed through mounting holes 104 on the pivot plate 72, and secured with nuts 106 for adjusting and fixing the angle of the pivot plate 72 with respect to the slide plate 70.

The vertical mounting plates 76 and 78 for mounting the cutter discs 32 are two parallel, laterally spaced metal plates attached to the pivot plate 72 at right angles to the pivot plate 72 preferably by welding. Each vertical mounting plate 76, 78 has a coaxially alined mounting hole 108 and 110, respectively, for mounting a stationary cylindrical support shaft 112 to the vertical mounting plates 76 and 78, respectively, for supporting the cutter discs 32. The support shaft 112 is provided with threaded ends and is placed through the mounting holes 108 and 110 secured to the vertical mounting plates 76 and 78, respectively, with nuts 114 and 116, respectively, threaded to the ends of the support shaft 112.

As shown in FIG. 4, there are eleven cutter discs 32 mounted to the support shaft 112 arranged at equal, laterally spaced intervals in a generally parallel spaced configuration on a rotatable support tube 120. Each of the cutter discs 32 is fixedly attached to the support tube 120, preferably by welding. Annular metal spacer elements 122 are also attached to the support tube 120 for separating and spacing the cutter discs 32.

Each cutter disc 32 has a generally circular peripheral configuration and in cross section has a concavo-convex shape formed by curving the ends of the plate inward with a relatively large radius of curvature from the center of the plate. The outer circumferential edge 123 of each cutter disc 32 is sharpened by chamfering one side of the cutter disc along the entire outer periphery of the disc. The cutter discs 32 are preferably fabricated out of a relatively hard corrosion-resistant metal such as heat-treated stainless steel.

The support tube 120 for the cutter discs 32 has a concentric interior through bore 126 with stepped concentric counterbores 128 and 130 on opposite ends for fitting a tapered roller bearing 132 and a shaft seal 134 on both ends of the support tube 120. The bearings 132 and shaft seals 134 are press-fitted or similarly attached to the counterbores 128, 130 of the support tube 120. The bearings 132 are journaled to the stationary support shaft 112 supporting the support tube 120 and cutter discs 32 for rotation.

Shaft bushings 140 are press-fitted to the support shaft 112 in the area of the shaft seals 134 to prevent the shaft seals 134 from wearing the support shaft 112. Spacer elements 142 and 144 are provided between the shaft bushings 140 and vertical mounting plates 76 and 78, respectively, of the support carriage 34 on either end of the support shaft 112 for limiting the axial movement of the support tube 120 on the support shaft 112.

The cutter discs are thus freely rotatably mounted on a support carriage that can be slid laterally in a horizontal direction for changing the horizontal location of the discs or pivoted about a horizontal axis to change angular incline in the lateral direction for angling the cutting plane of the cutter discs for cutting a sloped surface. In addition, the slide support 60 can be attached to cross support member 43 of the frame 28 at an angle to the cross support member 43 so that the cutter discs 32 are oriented at an angle to the direction of motion of the frame 28 and windrow the broken-up asphalt material.

OPERATION

In operation the prime mover is moved at a relatively slow speed, usually at about 0.40 mph or less, across the pavement to be treated 15, pulling the trailer 12, the combustion device 16, scarifying tool 20, and asphalt cutting apparatus 10 behind. As the equipment is pulled across the pavement 15, the combustion device 16 heats and softens the pavement. The scarifying tool 20 then breaks the pavement up into irregular-sized chunks of asphalt aggregate material.

The cutter discs 32 following behind the scarifying tool 20 are forced into the broken asphalt material by the clamp cylinder 46 that is in its extended position, maintaining a downward force on the order of 14,000 lbs or more on the cutter discs 32. The freely rotatable cutter discs 32 thus rotate through the broken asphalt aggregate material and further dislodge and cut the material. The knife action produced by the sharpened edge of the cutter discs rotating through the asphalt aggregate material makes a clean and even cut through the asphalt.

In addition, the curvature of the cutter discs 32 and, if desired, the orientation of the cutter discs 32 relative to the direction of motion of the frame tend to windrow the cut asphalt aggregate material into spaced piles of material that can be more easily picked up for reconditioning or reclaiming by additional apparatus traveling behind the asphalt cutting apparatus 10. The angle of the cutter discs 32 relative to the direction of motion of the main frame can be adjusted as desired to control the height and spacing of the windrowed piles of material by positioning the T-shaped slide support 60 at different angles to cross support member 43 and the trailer frame 12, as previously explained.

The depth of the cutter discs can be set by cylinder 46, which also clamps the discs at a selected depth. The horizontal location of the cutter discs 32 can be adjusted and set utilizing the slide mounting of the support carriage 34 so that the end cutter disc is alined as shown in FIG. 2 with the curb and gutter 27 to cleanly cut the asphalt pavement adjacent to the gutter away from the gutter. In addition, the cutting plane of the cutter discs 32 can be set utilizing the pivot plate 72 and pivot adjusting bolts 102.

For cutting a sloped surface the adjusting nuts 106 on the pivot adjusting bolts 102 are set so that the cutter discs are disposed at an angle to the pavement surface with the cutter discs adjacent to the gutter 27 lower than the remaining discs for cutting a maximum amount of material near the gutter to produce a surface that slopes upward from the gutter.

Thus the asphalt cutting apparatus of the invention provides an effective means for breaking up asphalt pavement on a roadway or the like including material adjacent to a curb or gutter. Although the apparatus has been described in a preferred embodiment for use in combination with an asphalt scarifying tool, it is to be understood that the apparatus will also function effectively to break up asphalt when used alone. Additionally, although the asphalt cutting apparatus has been described as having a relatively narrow width movable support carriage, it is to be understood that the apparatus may be constructed with a series of support carriages or with a wider support carriage with more discs for removing material across the entire length of a roadway.

Although the present invention has been described with a certain degree of particularity, it is understood that the present disclosure has been made by way of example and that changes in details of structure may be made without departing from the spirit thereof.

What is claimed is:

1. In apparatus for cutting or breaking up a paved asphalt surface comprising:

a wheeled vehicle;

a main frame pivotally attached at a front end portion to said vehicle for vertical movement relative to said pivotal attachment and having an orientation generally parallel to a longitudinal axis of said vehicle;

a hydraulic clamp cylinder coupled to said frame to adjust the elevation of the rear end portion of said frame and to hold said frame at a selected elevation;

a generally horizontal slide support adjustably movably attached to said frame to position said slide support at different angles to the longitudinal axis of said main frame;

a cutter disc support carriage comprising a slide plate slidably mounted to the slide support, a pivot plate pivotally attached to said slide plate and a pair of spaced parallel cutter disc support plates attached to the pivot plate at substantially right angles to said pivot plate;

a stationary support shaft mounted to said support plates of said support carriage; and a plurality of circular cutter discs freely rotatably mounted in series to said support shaft with each cutter disc having a sharpened outer circumferential edge, whereby as the vehicle is moved in a direction parallel to its longitudinal axis along the asphalt surface the cutter discs are pulled across the surface and are forced into the asphaltic material by said clamp cylinder and roll through and cut or break up the asphaltic material, said slide support being adjustably movable at an angle to the longitudinal axis of said vehicle so that the cutter discs are oriented at an angle to the direction of motion of said main frame for windrowing the broken-up material, said slide plate of the support carriage being adjustably movable laterally axially along the slide support for changing the horizontal location of the cutter discs, said pivot plate of the support carriage being pivotal with respect to said slide plate for changing the lateral slope and thereby the cutting depth of the cutter discs relative to one another for cutting a sloped surface.

2. Cutting apparatus for use in operative association with a vehicle to cut asphaltic material forming a paved asphalt surface or the like, said apparatus comprising:

a frame:

means for connecting said frame to a vehicle to travel therewith including a first force-applying member for raising and lowering the rear end portion of said frame in relation to a forward pivot and to hold said frame at a selected elevation; and a cutting assembly supported in a depending manner from said frame including a support carriage and a plurality of laterally spaced cutter discs freely rotatably mounted on a shaft supported by said support carriage whereby, as said cutting assembly is moved along the asphalt surface by the vehicle, said cutter discs are forced into the asphaltic material by said first force-applying member to cut through said asphaltic material, said cutting assembly being adjustably movable in relation to said frame in a direction laterally axially of the direction of vehicle movement and including a second force-applying member for moving said cutting assembly for changing the horizontal location of said cutter discs, and further being adjustably movable to a selected angle in relation to said frame and to the direction of vehicle movement for windrowing the cut material, said shaft and cutter discs being pivoted with respect to said carriage to a selected lateral slope for changing the lateral slope and thereby the cutting depth of said cutter discs relative to one another and for cutting a sloped surface.

3. Cutting apparatus as defined in claim 2 including a generally horizontal slide support adjustably movably attached to said frame and adjustably movably carrying said carriage.

4. Cutting apparatus as defined in claim 3 wherein said carriage has a slide plate slidably mounted to said slide support, a pivot plate pivotally attached to said slide plate, and a pair of spaced parallel cutter disc support plates attached to said pivot plate at substantially right angles to said pivot plate, said shaft being supported at the ends by said pair of support plates.

5. Cutting apparatus as defined in claim 2 wherein each said cutting disc has a generally concavo-convex cross section and each has a sharpened outer circumferential edge.

6. Cutting apparatus as defined in claim 2 wherein each of said first and second force-applying members is a hydraulic cylinder.

* * * * *